US007849813B2

(12) United States Patent
Fett et al.

(10) Patent No.: US 7,849,813 B2
(45) Date of Patent: Dec. 14, 2010

(54) APPARATUS FOR APPLYING A LIQUID TO A PASSING WEB

(75) Inventors: Thomas Fett, Wesseling (DE); Walter Kühn, Hennef (DE)

(73) Assignee: Reifenhauser GmbH & Co. KG Maschinenfabrik, Troisdorf (DE)

( * ) Notice: Subject to any disclaimer, the term of this patent is extended or adjusted under 35 U.S.C. 154(b) by 805 days.

(21) Appl. No.: 11/789,437

(22) Filed: Apr. 24, 2007

(65) Prior Publication Data

US 2008/0011226 A1 Jan. 17, 2008

(30) Foreign Application Priority Data

May 12, 2006 (EP) ..... 06009886

(51) Int. Cl.
*B05C 1/00* (2006.01)

(52) U.S. Cl. ..... 118/244; 118/211; 118/212; 118/213

(58) Field of Classification Search ..... 118/244, 118/211, 212, 213
See application file for complete search history.

(56) References Cited

U.S. PATENT DOCUMENTS 1,953,507 A * 4/1934 Schnaier ..... 53/236
5,258,146 A * 11/1993 Almquist et al. ..... 264/401
5,709,747 A * 1/1998 Goldwasser ..... 118/211
6,183,847 B1 2/2001 Goldwasser ..... 428/219
2003/0185987 A1* 10/2003 Emery et al. ..... 427/360

FOREIGN PATENT DOCUMENTS

EP 0997576 5/2000

* cited by examiner

*Primary Examiner*—Parviz Hassanzadeh
*Assistant Examiner*—Charles J Capozzi
(74) *Attorney, Agent, or Firm*—Andrew Wilford

(57) ABSTRACT

An apparatus for applying a liquid to a moving web has an applicator element having a surface extending transverse to the web-travel direction and positioned to contact the moving web. Liquid applied to the surface is transferred to the moving web where the moving web contacts the surface. A support spaced in the web-travel direction from the applicator element has a plurality of guides extending transverse to the web-travel direction, with at least some of the guides overlapping others of the guides. Respective shields slidable in the guides transverse to the direction extend between the web and the surface so that where the shields extend between the moving web and the surface there is generally no transfer of the liquid from the surface to the moving web. Respective adjusters connected to the shields shift same in the respective guides between positions spaced from one another to positions at least partially overlapping one another.

13 Claims, 5 Drawing Sheets

APPARATUS FOR APPLYING A LIQUID TO A PASSING WEB

FIELD OF THE INVENTION

The present invention relates to an apparatus for applying a treatment fluid to a passing web. More particularly this invention concerns an applicator device for applying a liquid to a passing textile web.

BACKGROUND OF THE INVENTION

In numerous textile operations a fabric web is treated with a fluid medium, typically a liquid, by contact with an application surface, across which the fabric web is guided so that the fluid medium can be applied to the fabric web in the contact regions between the application surface and the fabric web. To leave uncoated strips on the web, it is further known to provide a plurality of covering elements or shields that engage between the web and respective portions of the application surface so that no contact can take place between the fabric web and application surface in these shielded regions, and no fluid transfer can be effected. Fluid media within the scope of the invention are particularly liquid media and lubricants that are preferably applied onto non-woven fabrics or non-woven webs. Lubricants include, for example, wetting agents, particularly surfactants and mixtures thereof that are preferably applied onto the fabric web in the form of solutions or emulsions. Such liquids often need to be applied in stripes to the passing web.

A device of the type mentioned above is basically known from practice. This device uses a rotating application roller across which the fabric web is guided. On the application roller shield strips are provided, thus creating a strip application of the fluid media and/or lubricants onto the fabric web.

From practice a device is also for displacing the shields to a certain degree in order to change the positions of the liquid-free strips. However, when the width of the shielded region is supposed to be changed, shields having different widths must be replaced in a relatively complex fashion. These known devices are therefore characterized by little flexibility and/or variability. In addition, further processing of the fabric web, particularly the thermal and/or mechanical and/or chemical processing of the fabric web, influences the positions and also the widths of the application regions or strips. The limited adjustment of the shielded regions thus has substantial disadvantages.

OBJECTS OF THE INVENTION

It is therefore an object of the present invention to provide an improved apparatus for applying a liquid to a passing web.

Another object is the provision of such an improved apparatus for applying a liquid to a passing web that overcomes the above-given disadvantages, in particular that is characterized by flexibility and variability and with which particularly the shielded regions can be easily and flexibly adjusted and that nevertheless is characterized by simplicity and functional reliability.

SUMMARY OF THE INVENTION

An apparatus for applying a liquid to a web moving in a predetermined web-travel direction. The apparatus has according to the invention an applicator element having a surface extending transverse to the direction and positioned to contact the moving web, means for applying the liquid to the surface such that the liquid is transferred to the moving web where the moving web contacts the surface, a support spaced in the web-travel direction from the applicator element, a plurality of guides on the support extending transverse to the web-travel direction, at least some of the guides overlapping others of the guides transverse to the web-travel direction, respective shields slidable in the guides transverse to the direction and extending between the web and the surface so that where the shields extend between the moving web and the surface there is generally no transfer of the liquid from the surface to the moving web, and respective adjusters connected to the shields for shifting same in the respective guides between positions spaced from one another to positions at least partially overlapping one another.

A woven or nonwoven fabric web made of filaments of thermoplastic material, for example, can be treated with the apparatus of this invention, as can other textile webs. As mentioned above the fluid media within the scope of the invention are particularly liquids, especially lubricants and lubricating agents that are applied onto the fabric web to: adjust and/or modify the properties of the fabric web. As explained above, they can be wetting agents, particularly surfactants and mixtures thereof that are preferably applied in the form of solutions or emulsions. A fluid medium then also refers to such a solution or emulsion. In principle, however, also any other fluid or liquid media can be applied onto the fabric web and the "term liquid" is not intended restrictively.

Suitably, the bottom face of the fabric web is guided across the top of the application surface to apply the fluid medium. As a result, the fluid medium is applied in the contact regions between the fabric web and the application surface, while it is not applied in the regions of the application surface covered by the shields. Preferably the fluid medium is applied to the fabric web in the contact regions continuously or without interruptions. Of course, the shields are impermeable or substantially impermeable to the fluid medium. When guiding the fabric web across the application surface, these shields are positioned between the application surface and the fabric web, thus preventing contact of the fabric web with the fluid medium in these regions.

The fact that the shields are positioned directly adjacent each other means in particular that no gap or clearance can develop between the adjoining shields or that a minimal gap is present between the adjoining shields. A minimal gap relates to a distance of less than 2 mm, preferably less than 1 mm and particularly less than 0.5 mm between the two adjoining shields. When the shields are disposed such that they overlap, the shields in question are suitably disposed on top of each other in sections.

According to a particularly preferred embodiment of the invention, the application surface is the surface of a cylindrical application roller. It is within the scope of the invention that the application roller rotates and that the roller preferably is immersed in sections into a container holding a body of the fluid or liquid medium. This way, the application roller can be supplied continuously with the fluid medium to be applied onto the fabric web. It is furthermore within the scope of the invention that the fabric web is conveyed or moved across the application roller transversely or perpendicularly to the longitudinal axis of the application roller. Furthermore the roller is typically rotated such that its contact region with the web moves codirectionally with the web, and also normally at the same speed for uniform transfer.

As has already been pointed out above, the preferred embodiment of the invention relates to a device that allows a strip application of the fluid medium to the fabric web. As a result, the fabric web is only wetted in strips with the fluid medium and/or the lubricant and the properties of the fabric web are only the influenced and/or modified in these strips in accordance with the effect of the fluid medium. In this preferred embodiment, the shields are configured as shield straps. Suitably, the longitudinal extension are these shield straps is oriented transversely or perpendicularly to the longitudinal axis of the application roller and generally parallel to the web-travel direction. The shield straps cover strips where no contact occurs between the application surface or application roller and the fabric web and in which consequently the fluid medium or the lubricant does not influence or modify the fabric web.

It is within the scope of the invention that the shield straps are displaceable, specifically they can shift on the preferred application roller in the direction of the longitudinal axis of this application roller, which itself is normally perpendicular to the web-travel direction. According to the invention, the mounting clips connected at least partially with ends of the shield straps are oriented or disposed in a special way for the displacement of the shield straps. It this within the scope of the invention at least a portion of the mounting clips are disposed offset to each other in the adjusting device, such that during displacement of these offset mounting clips at least a portion of these mounting clips can be displaced and/or moved past each other across part of their displacement path without colliding.

In the preferred embodiment of the application roller, the mounting clips can be displaced in the direction of the longitudinal axis of the application roller. When these two mounting clips are moved past each other without colliding and when shield straps are connected to both mounting clips, these shields or shield straps overlap. In the case of such collision-free displacement of mounting clips, the shields or shield straps connected to the mounting clips can thus be displaced actually on top of each other.

It is within the scope of the invention that the adjusting device comprises linear adjusters or adjusting rods that can be operated independently of each other, that at least one mounting clip is connected to each adjusting rod, and that the actuation or displacement of an adjusting rod shifts the respective mounting clip connected thereto. When a shield or shield strap is connected to this mounting clip, the shield or shield strap is displaced across the application surface/application roller as the mounting clip is displaced. According to a preferred embodiment of the invention, only one mounting clip is connected to each adjusting rod. The adjusting rods are suitably oriented parallel to each other and preferably parallel to the longitudinal axis of the application roller. According to a preferred variant, a plurality of adjusting rods are disposed in one plane, preferably in a horizontal plane, and the group of coplanar rods is responsible for a respective group of shields in turn covering a respective region of the applicator surface. It is within the scope of the invention that the adjusting rods are configured as threaded spindles. Suitably, an adjusting spindle is provided with an external thread, and the mounting clip forms or has a nut connected to this adjusting spindle and having a corresponding internal thread. By rotating the adjusting spindle, the mounting clip is displaced on the associated adjusting spindle in the longitudinal direction of the adjusting spindle. The adjusting rods/adjusting spindles can be operated manually or automatically. This embodiment guarantees very precise guidance of the mounting clips and consequently also very exact displacement of the shields.

In principle, other configurations of the adjusting device according to: the invention are conceivable as well. For example, a plurality of adjusting rods could be provided to which the mounting clips are clamped.

According to a particularly preferred embodiment of the invention, groups of adjusting rods are provided and each group of adjusting rods is associated with at least a partial region of the application surface. According to this embodiment, thus a plurality of groups are provided, each group being associated with a plurality of adjusting rods. Each group of adjusting rods, including the mounting clips connected respectively to the adjusting rods and the shields in turn optionally connected thereto, is provided to cover at least a partial region of the application surface/application roller. The mounting clips with the shield optionally connected thereto can preferably only be displaced in this partial region. In other words, only a limited displacement path is associated with the individual mounting clips. In the case of the preferred application roller, the application roller in this embodiment is suitably divided into several partial regions with respect to its longitudinal direction, which regions preferably have the same length. According to a preferred embodiment, each group of adjusting rods is disposed in a plane or in a horizontal plane. The plurality of groups of adjusting rods are then suitably disposed in planes disposed on top of and parallel to each other or in horizontal planes that are parallel to each other. This creates basically a matrix of adjusting rods/adjusting spindles.

It is within the scope of the invention that shields are connected only to some of the mounting clips. In other words, according to this embodiment more mounting clips are provided than shields/shield straps used in the operation of the device. In this way, diverse variation possibilities are obtained and above all it is possible to specifically cover smaller regions of the application surface/application roller. A very preferred embodiment of the invention is characterized in that the shields, if necessary, can be removed or decoupled at their ends from the respective mounting clips and/or that shields can be connected to empty or free mounting clips. The shields can be removed from their associated mounting clips and can then be connected to other free mounting clips. Of course, if necessary, it is also possible to connect additional shields to mounting clips.

According to a particularly preferred embodiment of the invention, the shield straps are always only connected at one end to the adjusting device or to mounting clips of the adjusting device. In other words, the shield straps in this embodiment have one free end and rest loosely on the application surface or application roller with respect to this end. In principle, however, the shield straps can also be connected on both ends to the adjusting device or to mounting clips flanking the applicator roller.

The shield straps are preferably made of plastic, particularly of fiber-reinforced or glass fiber-reinforced plastic and particularly preferred of Teflon™ glass-fiber-reinforced plastic. The shield straps, however, can basically also made of sheet metal, for example.

The invention is based on the realization that the device according to the invention allows extremely flexible and variable adjustment of the shielded regions on a fabric web. Unlike with the measures known from the state of the art, in particular the width of a shielded region can be implemented easily and without great effort. It therefore becomes possible according to the invention that the adjusting device according to the invention shifts the shields or shield straps to overlap or sit directly adjacent each other. Since the invention allows easy adjustment of the degree of the overlap, the widths of the shielded regions can be adjusted continuously and precisely, the minimum strip width being the width of the narrowest strap and the maximum strip width being the sum of the widths of all the straps. In the adjusting device according to the invention, very exact guidance of the mounting clips and the shields connected thereto is guaranteed. The device according to the invention allows a targeted independent adjustment of the positions and widths of the shielded regions, even during operation of the device. No undesirable interruptions and conversion times are required. In addition, the variable and precise adjustment of the shielded regions can compensate for the negative influence that further processing steps have on the positions and widths of the shielded regions on the fabric web. It should furthermore be highlighted that the device according to the invention is easy and inexpensive to produce. It is particularly significant that also existing systems, for example those used to produce non-woven fabrics, can be retrofitted with the device according to the invention without difficulty and without great expense.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
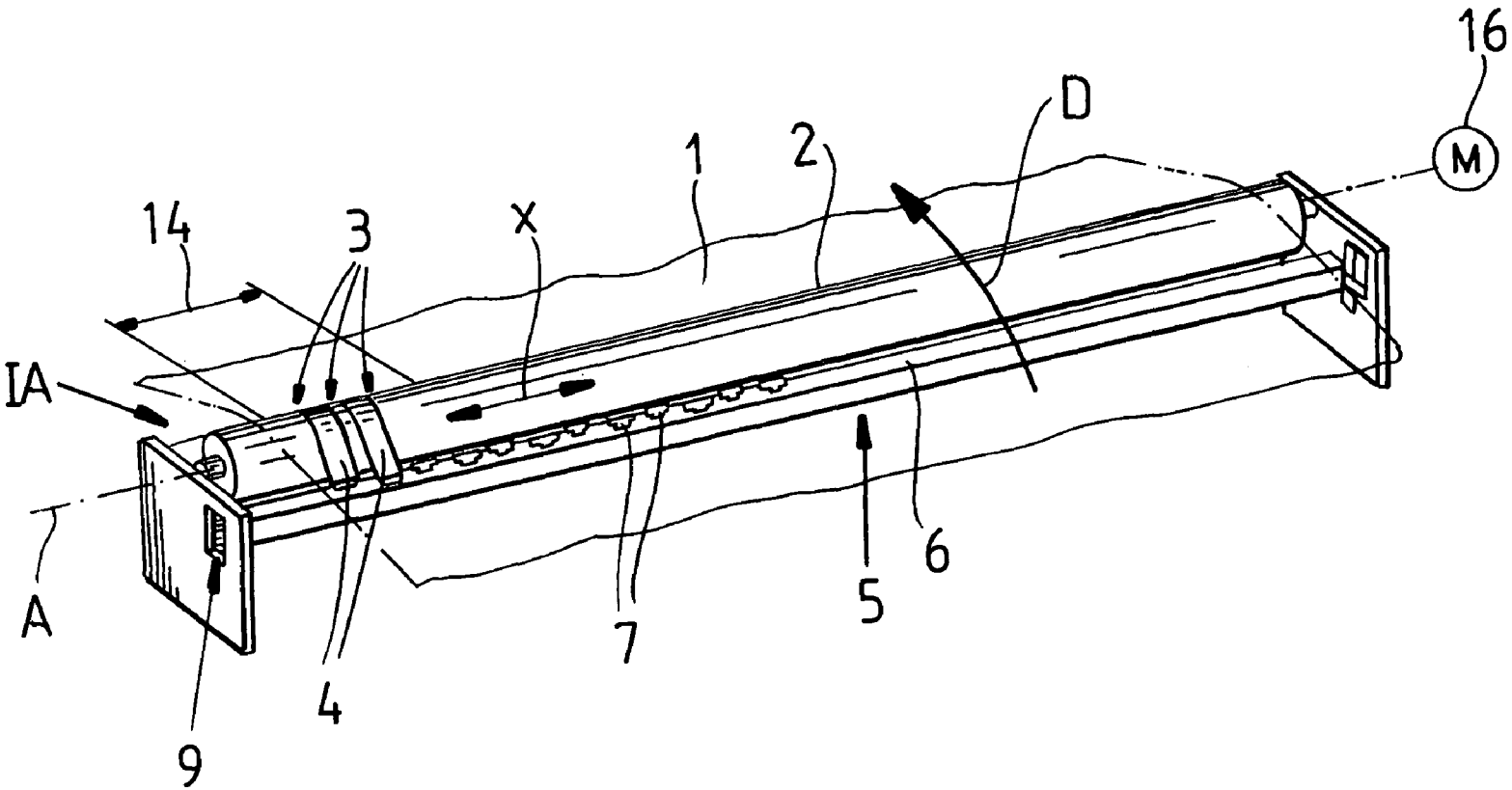
FIG. 1 is a partly diagrammatic perspective view of the apparatus according to the invention.
Figure 1A:
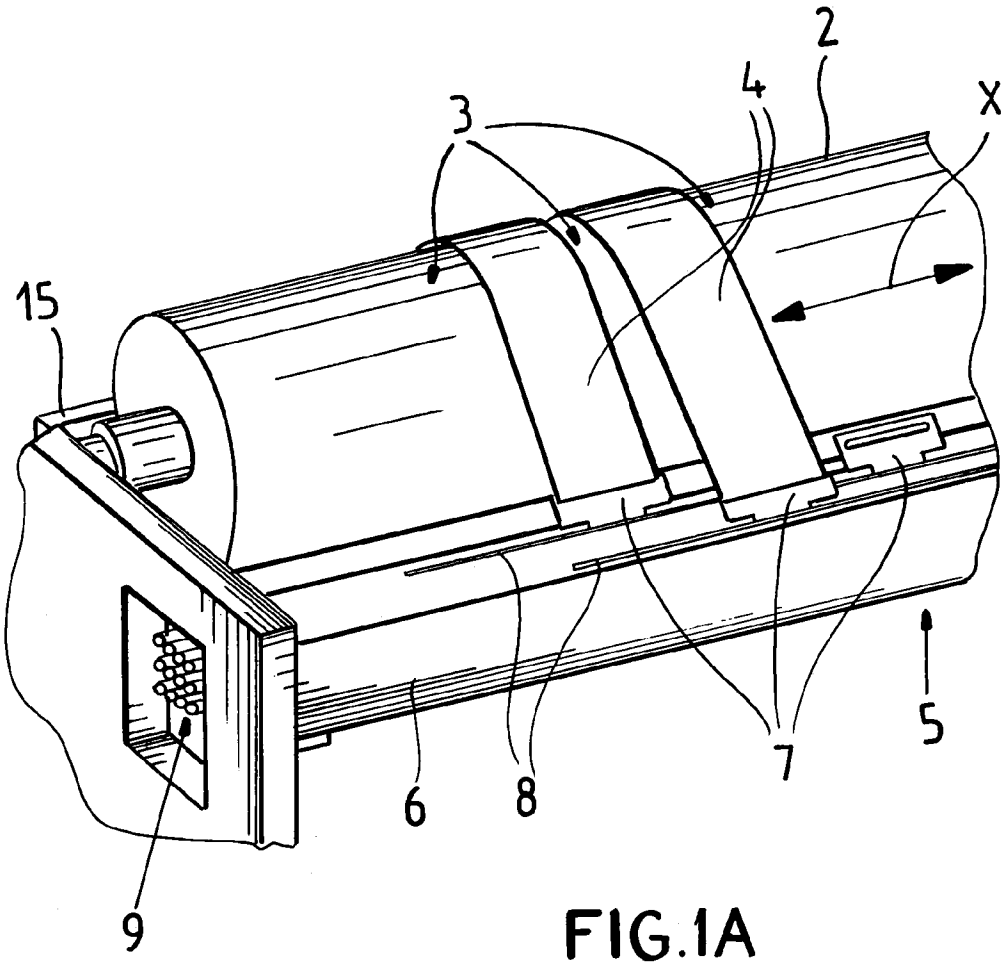
FIG. 1A is a large-scale view of the detail indicated at IA in FIG. 1.

As seen in FIGS. 1 and 1A, a device according to the invention applies fluid media or lubricants to a fabric web 1, preferably a non-woven web 1, that is guided in a horizontal web-travel direction D across an application surface formed by the surface of an application roller 2 centered on a horizontal axis A perpendicular to the direction D. The application roller 2 is cylindrical and is rotated by a motor illustrated schematically at 16 so that in its upper region where it contacts the web 1 it moves codirectionally with the web 1 and preferably at the same speed. The roller 2 sits in a supply trough 15 (FIG. 1A) filled with a treatment liquid, e.g. an avivage solution, so that as it rotates it picks up the liquid and transfers it to the bottom face of the passing web 1 in regions 3 where it contacts same.

Figure 4:
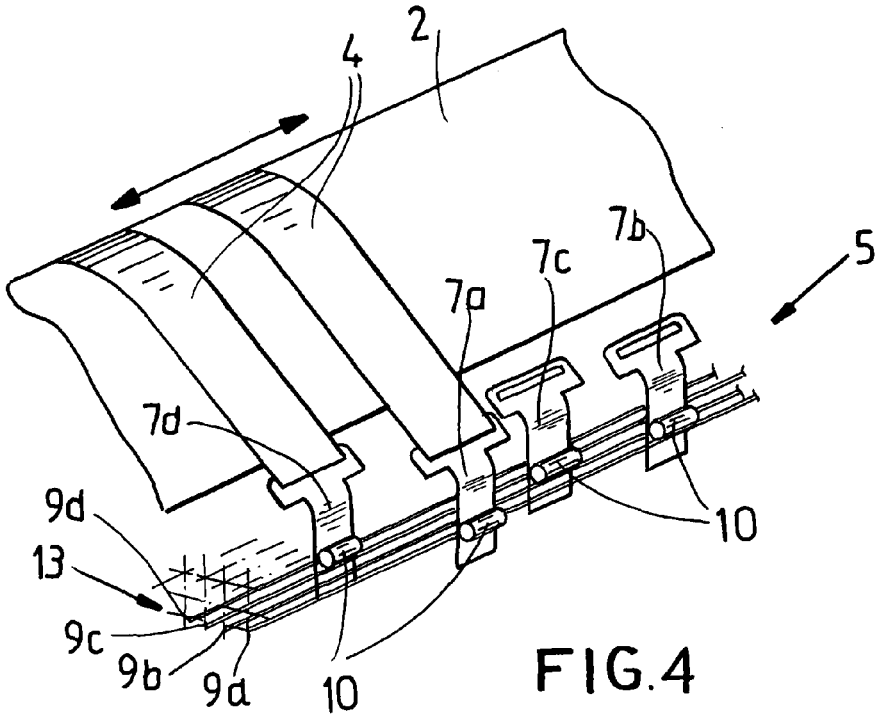
FIG. 4 is a detail view illustrating the present invention.

The device according to the invention is provided with a plurality of shields configured as shield straps 4. In FIGS. 1, 1A, and 4 only two shield straps 4 are illustrated for simplicity reasons. More shield straps 4 can be connected to the device according to the invention (see for example FIG. 5). The shield straps 4 cover regions on the application roller 2, so that no contact occurs between the non-woven web 1 and the application roller 2 in these shielded regions. In this way, no fluid medium is applied onto strips of the non-woven web 1 as it moves past. On the other hand, fluid medium is applied onto the non-woven web 1 in the strip-shaped contact regions 3 between the shield straps 4. As a result, a strip application of the fluid medium or lubricant onto the non-woven web 1 is achieved, the web 1 is striped with the liquid.

The shield straps 4 can be displaced on the application roller 2 or relative to the application roller 2 in a direction X parallel to the longitudinal axis A of the application roller 2, in both directions. An adjusting device 5 with an elongated housing 6 is fixed immediately upstream in the direction D from the roller 2. In the adjusting housing 6 of the adjusting device 5, a plurality of mounting clips 7 can move in respective guide slots 8. In principle, one shield strap 4 can be connected to each mounting clip 7. Generally, however, a shield strap 4 is connected only to some of the mounting clips 7.

The mounting clips 7 can be displaced in the direction X, so that the shield straps 4 connected thereto also shift in the direction X. Adjacent mounting clips 7 are offset in the direction D in the adjusting device 5 so that adjacent straps 5 can be displaced past each other across a portion of the displacement path without colliding. The guide slots 8 or displacement paths of adjoining mounting clips 7 are offset from each other and in part overlap, so that the mounting clips 7 can pass each other without colliding. When shield straps 4 are connected to two such adjoining mounting clips 7, the displacement paths and/or guide slots 8 overlap, so that an overlap of these shield straps 4 on the application roller 2 is possible. The degree of overlap of these shield straps 4 may be varied and continuously adjusted by displacement of the mounting clips 7. It is also possible that two or more shield straps 4 can sit directly adjacent each other or directly follow each in the direction X. This possibility is illustrated particularly in FIGS. 5B and 5C.

As in the illustrated embodiment, it is preferable if the adjusting device 5 comprises adjusting spindles 9 that can be operated independently of each other. In the illustrated embodiment, a mounting clip 7 is connected to each adjusting spindle 9 that has an external thread not shown in detail, and the mounting clips 7 are each provided with a nut or connecting flange 10, through which the associated adjusting spindle 9 extends. The connecting flange 10 has a complementary internal thread. By rotating an adjusting spindle 9, the respective mounting clip 7 connected to this adjusting spindle 9 can be moved or displaced in the direction X. A shield strap 4 connected to a mounting clip 7 is thus displaced accordingly in the longitudinal direction of the application roller 2. In the illustrated embodiment, the adjusting spindles 9 are parallel to one another and parallel to the longitudinal axis A of the application roller 2.

Figure 2:
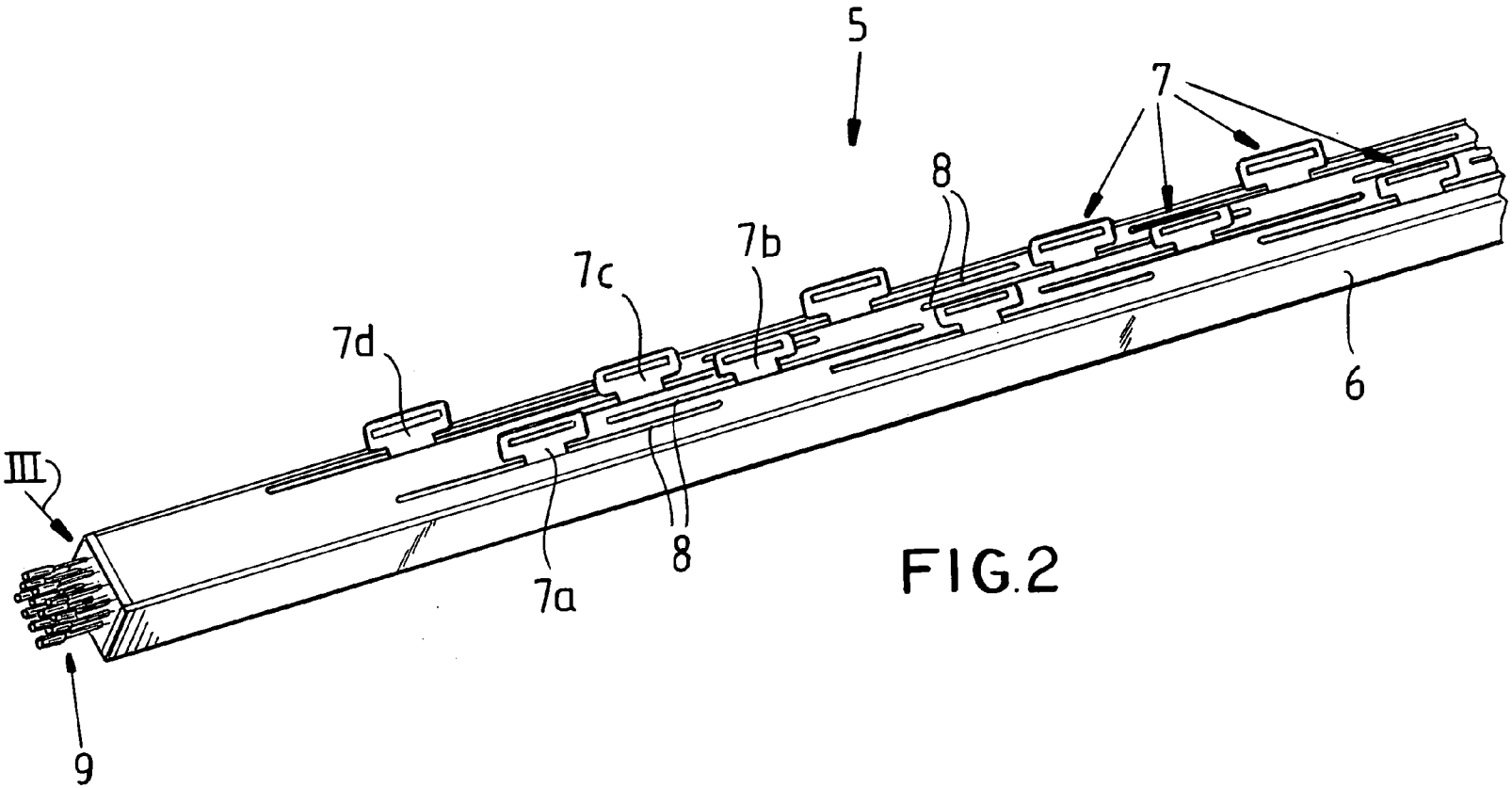
FIG. 2 is a detail view of a portion of the guide/support of this invention.
Figure 3:
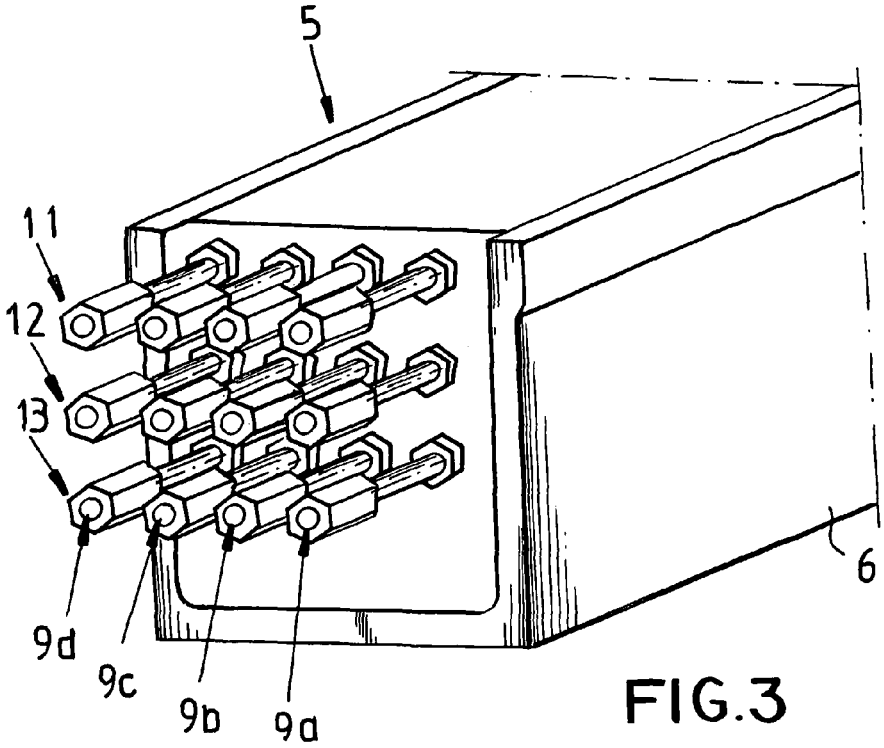
FIG. 3 is a large-scale view of the detail indicated at III in FIG. 2.

In the illustrated embodiment, three groups 11, 12, 13 of adjusting spindles 9 are provided, the groups 11, 12, 13 or the mounting clips 7 connected thereto being associated with respective portions of the application roller 2. Each group 11, 12, 13 of adjusting spindles 9 with mounting clips 7 connected thereto and optionally connected shield straps 4 only covers a limited region of the application roller 2, here about one-sixth of its length because there is another array of three groups on the opposite end of the housing 6. For example, the bottom group 13 of adjusting spindles 9 (see particularly FIG. 3) is responsible for shielding the outer left region 14 (FIG. 1) of the application roller 2. The mounting clip 7*a* is connected to the adjusting spindle 9*a* and can be displaced inside the associated guide slot 8 by rotating its adjusting spindle 9*a*. Similarly, the mounting clip 7*b* is connected to the adjusting spindle 9*b* of the bottom group 13 and upon actuating this adjusting spindle 9*b* the element can be displaced in the associated guide slot 8. FIG. 2 shows that the guide slots 8 of the mounting clips 7*a* and 7*b* partially overlap in the direction X. As a result, the mounting clips 7*a* and 7*b* can move past each other without colliding and, for example, an overlap of the shield straps 4 can be implemented that are connected to these mounting clips 7*a* and 7*b*. The same also applies to the mounting clips 7*c* and 7*d* that are connected to the adjusting spindles 9*c* and 9*d* of the bottom group 13 of adjusting spindles 9. In the illustrated embodiment, the adjusting spindles 9 of each group 11, 12, 13 are provided in one plane or in a horizontal plane. Here, a 3×4 matrix of adjusting spindles is used, one at each end of the housing 6.

Figure 5A:
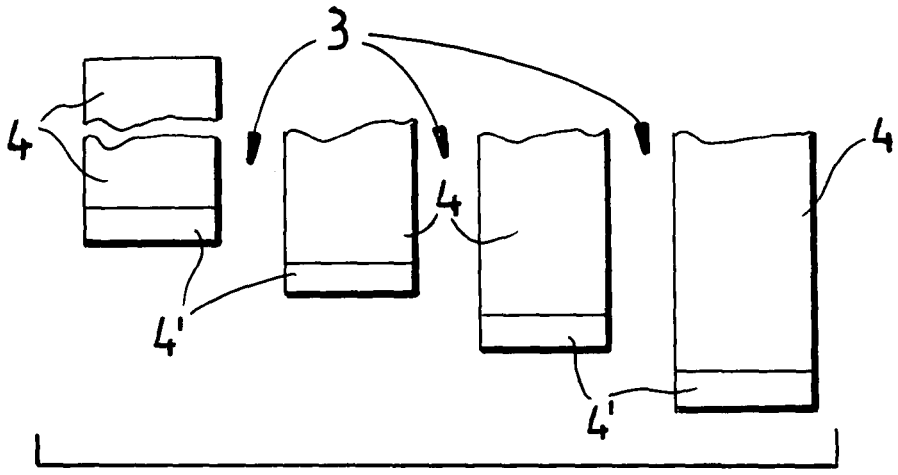
FIGS. 5A-5C are diagrammatic illustrations of how the instant invention is used.

If needed, additional shield straps 4 can be connected to free mounting clips 7 or shield straps 4 can be removed or decoupled from mounting clips 7 and connected, for example, to other mounting clips 7. As is shown in the embodiment, it is preferred if the shield straps 4 are connected only on one end to the adjusting device 5 or to the mounting clips 7 of the adjusting device 5. In other words, the shield straps 4 have a free end as shown in FIG. 5A and rest loosely on the application roller 2 with respect to this end. The codirectional movement of the web 1 and roller 2 holds them in position, while still allowing them to shift axially, especially when the system is running. If one of the straps 4 is not needed, it can simply be pulled out and either disconnected from its clip 7 at its upstream end, or folded down out of the way over the upstream side of the housing 6.

Figure 5B:
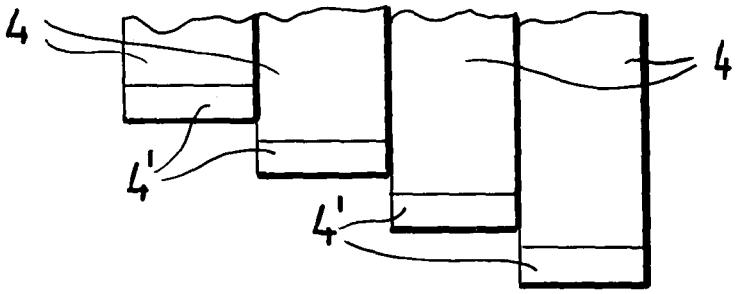
Figure 5C:
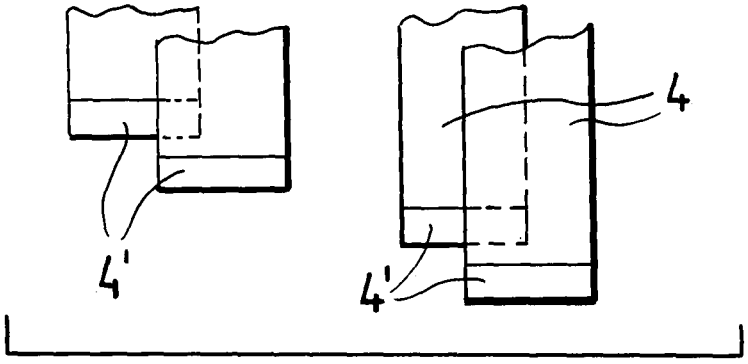

FIGS. 5A-5C shows three different functional positions of four shield straps 4 connected to mounting clips 7. In the position of FIG. 5A, all four shield straps 4 are at a spacing from each other. In other words, contact regions 3 are provided between the shield straps 4 in which the fluid medium can be transferred from the application roller 2 to the woven web 1. In the position of FIG. 5B, all four shield straps 4 are disposed directly adjacent one other, creating a wide dry stripe on the web 1 having a width equal to the sum of the widths of the fours traps 4. In the position of FIG. 5C, two shield straps 4 are disposed such that they overlap each other. The degree of the overlap is different for the two pairs of shield straps 4. By adjusting the degree of the overlap, the width of the resulting shielded regions can be adjusted continuously and variably.

We claim:

1. An apparatus for applying a liquid to a web moving in a predetermined web-travel direction, the apparatus comprising:

an applicator element having a surface extending transverse to the direction and positioned to contact the moving web;

means for applying the liquid to the surface such that the liquid is transferred to the moving web where the moving web contacts the surface;

a support spaced in the web-travel direction from the applicator element;

a plurality of guides on the support extending transverse to the web-travel direction, at least some of the guides overlapping others of the guides transverse to the web-travel direction, each of the guides being offset in the direction from at least one of the adjacent guides;

respective clips slidable in the guides transverse to the direction and each movable transversely past an adjacent clip to a position overlapping the adjacent clip in the direction without colliding therewith;

respective shields having upstream ends secured in the clips, the shields extending between the web and the surface, whereby where the shields extend between the moving web and the surface there is generally no transfer of the liquid from the surface to the moving web; and respective adjusters connected to the clips for shifting the clips in the respective guides and thereby shifting the shields between positions spaced from one another to positions at least partially overlapping one another.

2. The liquid-applying apparatus defined in claim 1 wherein the applicator element is a cylindrical roller rotatable about an axis generally perpendicular to the direction and parallel to the support and the surface is generally cylindrical.

3. The liquid-applying apparatus defined in claim 2 wherein the means for applying includes means for rotating the roller about its axis, and means for applying the liquid to the surface of the roller upstream in a rotation direction of the roller of a region of contact with the moving web relative to a roller-rotation direction.

4. The liquid-applying apparatus defined in claim 3 wherein the means for rotating the roller rotates the roller such that the roller surface is moving in the region of contact with the moving web codirectionally with the web.

5. The liquid-applying apparatus defined in claim 2 wherein the support is upstream in the web-travel direction from the roller and the shields are flexible elongated straps extending from the support downstream in the web-travel direction to the roller, whereby the codirectionally moving web and roller surface region exert tension on the straps and hold them taut.

6. The liquid-applying apparatus defined in claim 5 wherein the straps forming the shields each have relative to the web-travel direction an upstream end secured to the respective guide and a free and unattached downstream end.

7. The liquid-applying apparatus defined in claim 1 wherein the guides are arranged in at least two different rows spaced apart in the web-travel direction such that some of the shields can move transversely of the web-travel direction past others of the shields.

8. The liquid-applying apparatus defined in claim 1 wherein the support has a plurality of groups of the guides and the guides in each group overlap one another transversely of the direction.

9. The liquid-applying apparatus defined in claim 1 wherein the upstream ends are releasably attached to the respective clips.

10. The liquid-applying apparatus defined in claim 1 wherein the adjusters include respective threaded spindles in the support threadedly engaging the respective clips and rotatable to shift the respective shields transversely of the web-travel direction.

11. An apparatus for applying a liquid to a web moving in a predetermined web-travel direction, the apparatus comprising:

an applicator roller having a generally cylindrical surface centered on an axis extending transverse to the direction and positioned to tangentially contact a lower face of the moving web;

means for rotating the roller about its axis in a roller-rotation direction;

means for coating the surface of the roller upstream of a region of contact with the moving web relative to the roller-rotation direction such that the liquid is transferred to the moving web where the moving web contacts the surface;

a support spaced upstream in the web-travel direction from the applicator element;

a plurality of guides on the support extending transverse to the web-travel direction and offset from one another in the web-travel direction, at least some of the guides overlapping others of the guides transverse to the web-travel direction;

respective clips slidable in the guides transverse to the direction and movable transversely of the direction into positions overlapping one another in the direction;

respective shields having upstream ends connected to the clips and extending between the web and the surface, whereby where the shields extend between the moving web and the surface there is generally no transfer of the liquid from the surface to the moving web; and respective adjusters connected to the clips for shifting the clips in the respective guides between positions with the respective shields spaced from one another to positions at least partially overlapping one another.

12. The liquid-applying apparatus defined in claim 11 wherein the shields are flexible liquid-impermeable straps projecting downstream in the web-travel direction from the clips.

13. The liquid-applying apparatus defined in claim 12 wherein the web-rotation direction is such that the region of contact between the roller surface and the web moves in the web-travel direction, the straps having unattached free downstream ends extending downstream from the roller.

* * * * *